US011052684B2

(12) United States Patent
Johnson et al.

(10) Patent No.: US 11,052,684 B2
(45) Date of Patent: Jul. 6, 2021

(54) MEDIA REGISTRATION WITH PULLER CLAMP

(71) Applicant: Hewlett-Packard Development Company, L.P., Houston, TX (US)

(72) Inventors: Bruce G Johnson, LaCenter, WA (US); Elliott Downing, Vancouver, WA (US); Steve O Rasmussen, Vancouver, WA (US); Al Olson, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 158 days.

(21) Appl. No.: 15/759,346

(22) PCT Filed: Dec. 9, 2015

(86) PCT No.: PCT/US2015/064781

§ 371 (c)(1),
(2) Date: Mar. 12, 2018

(87) PCT Pub. No.: WO2017/099762

PCT Pub. Date: Jun. 15, 2017

(65) Prior Publication Data

US 2018/0257404 A1 Sep. 13, 2018

(51) Int. Cl.

| | |
|---|---|
| ***B41J 13/22*** | (2006.01) |
| ***B65H 5/08*** | (2006.01) |
| ***B65H 9/00*** | (2006.01) |
| ***B65H 9/10*** | (2006.01) |
| ***B41J 13/00*** | (2006.01) |
| ***B41J 13/02*** | (2006.01) |
| ***B41J 13/10*** | (2006.01) |

(52) U.S. Cl.

CPC ..... *B41J 13/22* (2013.01); *B41J 13/0036* (2013.01); *B41J 13/0054* (2013.01); *B41J 13/02* (2013.01); *B41J 13/106* (2013.01); *B65H 5/085* (2013.01); *B65H 9/004* (2013.01); *B65H 9/101* (2013.01); *B65H 2403/513* (2013.01); *B65H 2404/231* (2013.01)

(58) Field of Classification Search

CPC .... B41J 13/0036; B41J 13/0054; B41J 13/02; B41J 13/22; B41J 13/106; B65H 5/085; B65H 9/004; B65H 9/101; B65H 2403/513; B65H 2404/231

See application file for complete search history.

(56) References Cited

U.S. PATENT DOCUMENTS

| | | | |
|---|---|---|---|
| 3,206,194 | A | 9/1965 | Batthel |
| 4,506,881 | A | 3/1985 | Hunt et al. |
| 4,792,132 | A | 12/1988 | Jahme |

(Continued)

FOREIGN PATENT DOCUMENTS

| | | |
|---|---|---|
| EP | 1034924 | 9/2000 |
| JP | H05-142752 | 5/1993 |

(Continued)

*Primary Examiner* — Matthew G Marini
*Assistant Examiner* — Marissa Ferguson-Samreth
(74) *Attorney, Agent, or Firm* — Dicke Billig & Czaja PLLC

(57) ABSTRACT

A media registration system includes a puller clamp, and a puller track to support the puller clamp. The puller track is to open and close the puller clamp with movement of the puller clamp along the puller track.

15 Claims, 11 Drawing Sheets

(56) References Cited

U.S. PATENT DOCUMENTS

| | | | | | |
|---|---|---|---|---|---|
| 4,825,762 | A * | 5/1989 | Fischer | B41F 21/05 | 101/142 |
| 4,981,380 | A | 1/1991 | Nishida et al. | | |
| 5,203,549 | A * | 4/1993 | Bryson, Sr. | B65H 39/055 | 270/1.02 |
| 5,294,069 | A | 3/1994 | Blahnik | | |
| 5,456,544 | A | 10/1995 | Aoki et al. | | |
| 5,842,799 | A | 12/1998 | Yamamoto et al. | | |
| 6,129,350 | A * | 10/2000 | St. Ours | B41F 13/03 | 198/644 |
| 6,505,551 | B1 | 1/2003 | Kawabe et al. | | |
| 8,721,066 | B2 | 5/2014 | Asada et al. | | |
| 2004/0070140 | A1 | 4/2004 | Michels | | |
| 2010/0072697 | A1 | 3/2010 | Sokolowski | | |
| 2015/0049150 | A1 | 2/2015 | Muench et al. | | |
| 2015/0284203 | A1* | 10/2015 | Terrero | B65H 31/38 | 271/228 |
| 2016/0096698 | A1* | 4/2016 | Schoenmakers | B65H 5/068 | 271/228 |

FOREIGN PATENT DOCUMENTS

| | | | | |
|---|---|---|---|---|
| JP | H11-34794 | | 11/1999 | |
| JP | 2003089464 | * | 3/2003 | B65H 31/3045 |
| WO | WO-9105726 | | 5/1991 | |
| WO | WO-2012076671 | | 6/2012 | |

* cited by examiner

MEDIA REGISTRATION WITH PULLER CLAMP

BACKGROUND

Post-print operations may include aligning, stapling and/or stacking of printed media output. Post-print operations with inkjet media output, including un-dried or partially dried inkjet media output, may be difficult. For example, inkjet media output may be distorted from curl and cockle, may have reduced stiffness from increased moisture content, and/or may have increased surface roughness which, in turn, may increase sheet-to-sheet friction.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure.

Figure 1:
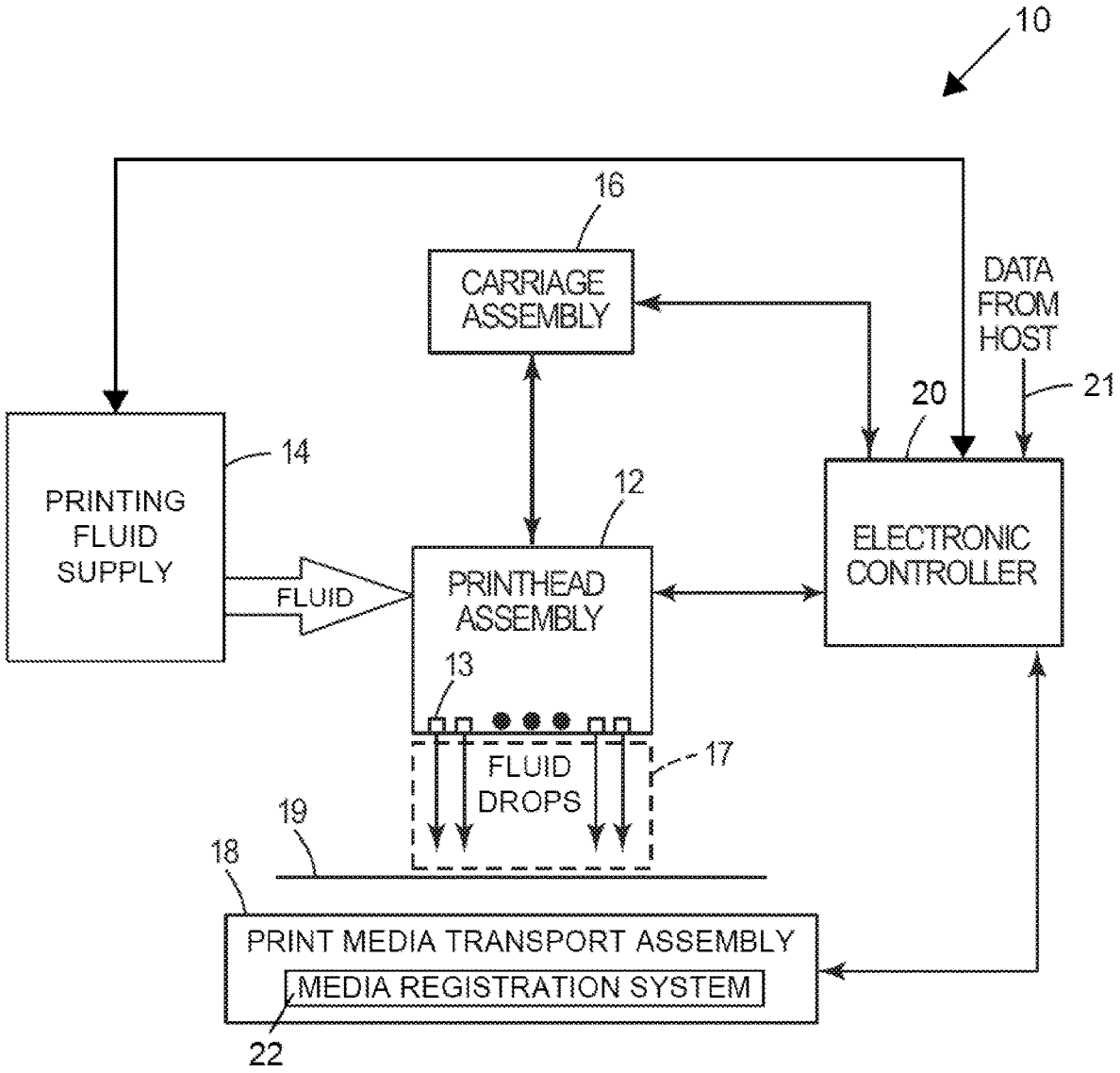
FIG. 1 is a block diagram illustrating an example of a printing system.

FIG. 1 illustrates an example of a printing system, such as inkjet printing system 10. Inkjet printing system 10 includes a fluid ejection assembly, such as printhead assembly 12, and a fluid supply assembly, such as printing fluid supply 14. In the illustrated example, inkjet printing system 10 also includes a carriage assembly 16, a print media transport assembly 18, and an electronic controller 20.

Printhead assembly 12 includes at least one printhead or fluid ejection device which ejects drops of printing fluid or other fluid through a plurality of orifices or nozzles 13. In one example, the drops are directed toward a medium, such as print media 19, so as to print onto print media 19 as printhead assembly 12 and print media 19 are moved relative to each other. Print media 19 includes, for example, any type of suitable sheet material, such as paper, card stock, transparencies, Mylar, fabric, and the like, packaging material, or other printable material.

Printing fluid supply 14 supplies printing fluid to printhead assembly 12. In one example, printhead assembly 12 and printing fluid supply 14 are housed together in an inkjet or fluid-jet print cartridge or pen. In another example, printing fluid supply 14 is separate from printhead assembly 12 and supplies printing fluid to printhead assembly 12 through an interface connection, such as a supply tube.

Carriage assembly 16 positions printhead assembly 12 relative to print media transport assembly 18 and print media transport assembly 18 positions print media 19 relative to printhead assembly 12. Thus, a print zone 17 is defined adjacent to nozzles 13 in an area between printhead assembly 12 and print media 19. Print media transport assembly 18 may include, for example, a variety of guides, rollers, wheels, etc. for the handling and/or routing of print media 19 through inkjet printing system 10, including transporting, guiding, and/or directing print media 19 to and/or away from print zone 17.

In one example, print media transport assembly 18 includes a media registration system, as identified at 22, for registering media within inkjet printing system 10. Registering media may be useful for post-print operations, such as stack alignment, stapling, offset, and other finishing operations.

In one implementation, electronic controller 20 communicates with printhead assembly 12, printing fluid supply 14, carriage assembly 16, and print media transport assembly 18. Electronic controller 20 receives data 21 from a host system, such as a computer, and may include memory for temporarily storing data 21. Data 21 represents, for example, a document and/or file to be printed. As such, data 21 forms a print job for inkjet printing system 10 and includes print job commands and/or command parameters. In one example, electronic controller 20 provides control of printhead assembly 12 including timing control for ejection of printing fluid drops from nozzles 13. As such, electronic controller 20 defines a pattern of ejected printing fluid drops which form characters, symbols, and/or other graphics or images on print media 19. Timing control and, therefore, the pattern of ejected printing fluid drops, is determined by the print job commands and/or command parameters.

Figure 2:
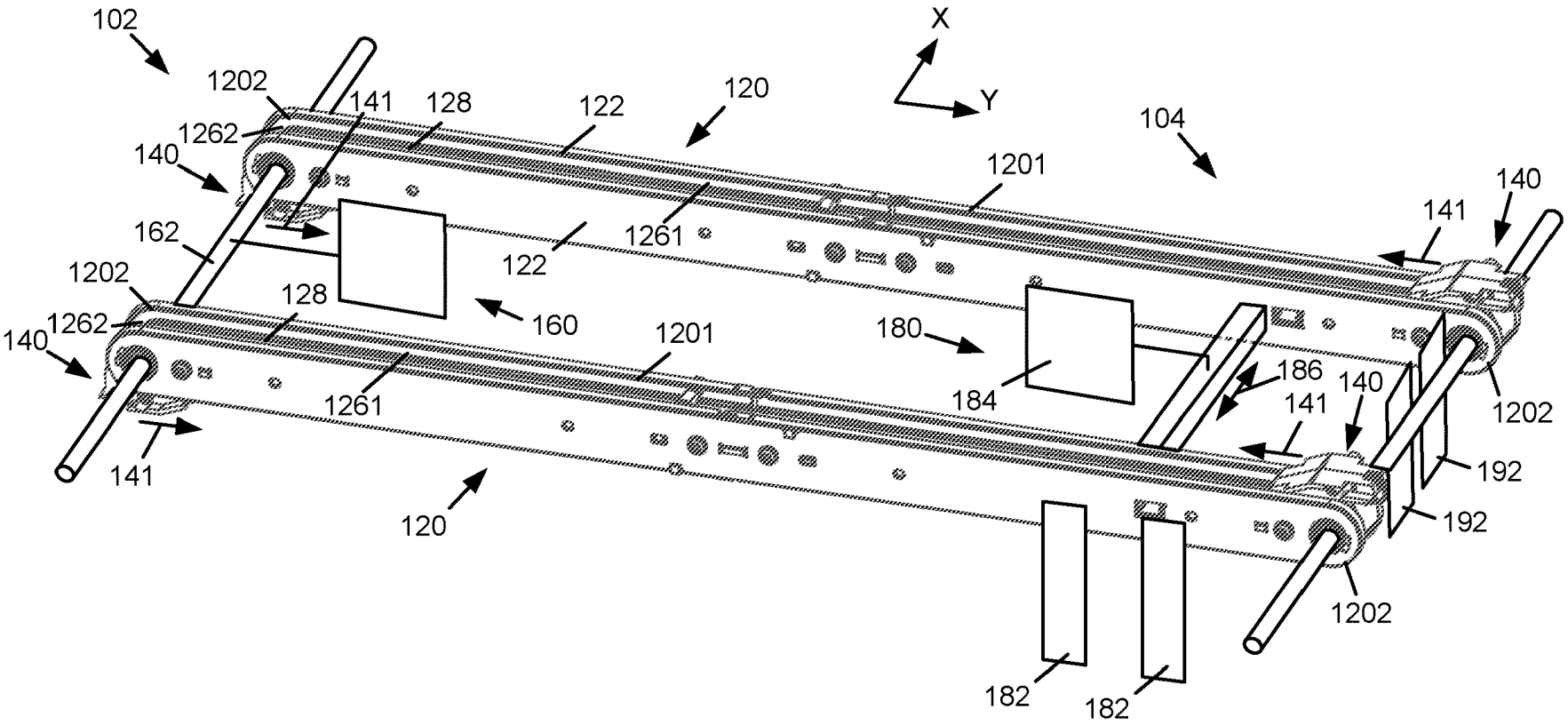
FIG. 2 is a schematic illustration of an example of a media registration system for a printing system.

FIG. 2 is a schematic illustration of an example of a media registration system 100, as an example of media registration system 22 (FIG. 1), for a printing system, such as inkjet printing system 10 (FIG. 1). In one implementation, media registration system 100 includes puller tracks 120, puller clamps 140 each supported on a respective puller track 120, and a puller drive system 160 to move puller clamps 140 along puller tracks 120. In one example, media registration system 100 also includes an X-registration system 180, with an X-registration wall (or walls) 182 to provide alignment in the X axis, and a Y-registration wall (or walls) 192 to provide alignment in the Y axis. While described as being "walls", X-registration wall (or walls) 182 and Y-registration wall (or walls) 192 may be formed by surfaces or other features.

In the illustrated example, media registration system 100, including each puller track 120, includes an end 102 and an opposite end 104. In one example, end 102 represents an "intake" or receiving end of media registration system 100, and end 104 represents a registration end of media registration system 100.

In one implementation, puller tracks 120, with respective puller clamps 140, include a pair of puller tracks 120 spaced from each other. In one example, puller tracks 120 are positioned on each side of a centerline of incoming media, for example, an outputted sheet of printed media. In one example, puller tracks 120 are attached to a fixed structure at one end, and a translating mechanism, such as X-registration system 180, at an opposite end. As such, a sheet of media, as captured by puller clamps 140, may be transported in one direction, such as the Y direction, and translated in another direction, such as the X direction, perpendicular to the direction of transport. This combination of transport and side-to-side translation provides for registration of the sheet of media in two directions, namely, X and Y directions, while maintaining control of the sheet during the process.

Puller tracks 120 guide puller clamps 140 and control opening and closing of puller clamps 140 as puller clamps 140 are moved or guided along puller tracks 120. For example, in one implementation, puller clamps 140 are opened to receive or capture a sheet of media, and are closed to transport the sheet of media and register the sheet of media, including, more specifically, align the sheet of media in the X axis and align the sheet of media in the Y axis, as further described herein. As such, puller clamps 140 transport a sheet of media to the registration area, maintain control of the media during X and Y alignment, and then release the media after the registration process is complete.

More specifically, in one example, as described below, as puller clamps 140 are moved within puller track 120 (for example, by a belt), puller clamps 140 are either opened or closed depending on a location of puller clamps 140 (including, more specifically, locations of hinged or pivoted portions of puller clamps 140) relative to straight and curved portions of puller track 120. As such, in one implementation, puller clamps 140 are opened as puller clamps 140 (for example, the hinged or pivoted portions of puller clamps 140) rotate around curved portions of puller track 120 (for example, 180 degree curved portions of puller track 120), and are closed as puller clamps 140 (for example, the hinged or pivoted portions of puller clamps 140) are in straight portions of puller tracks 120.

In one example, an input or intake sequence of media registration system 100 includes positioning of puller clamps 140 at "intake" or receiving end 102 of media registration system 100. For example, in one implementation, as a sheet of media approaches media registration system 100, puller clamps 140 are positioned along puller track 120 such that puller clamps 140 are held in an open or "media accept" position. With puller clamps 140 in the open or media accept position, a sheet of media, namely, a leading edge of the sheet media, may enter a throat or pinch of puller clamps 140. In one implementation, puller drive system 160 synchronizes a speed of movement of puller clamps 140 to a speed of output of printed media such that input to media registration system 100 is synchronized with output of the printing system. In one example, the input or intake sequence is repeated for each sheet in a print (or copy) job.

In the example illustrated in FIG. 2, media registration system 100 includes two puller clamps 140 on each puller track 120. While two puller clamps 140 are illustrated on each puller track 120, more or fewer puller clamps 140 may be utilized on each puller track 120.

Figure 4:
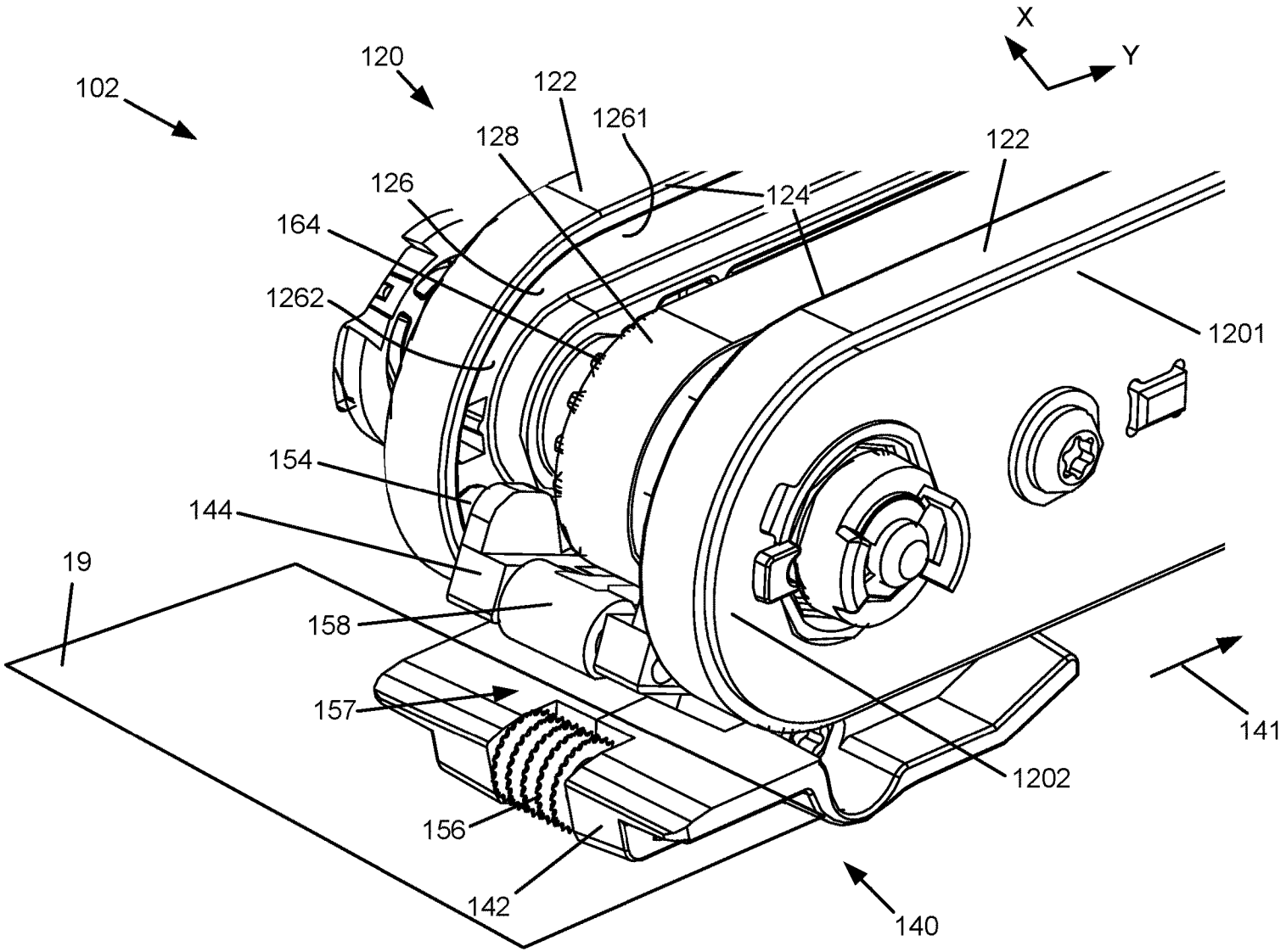
FIG. 4 illustrates an example of a portion of a media registration system with the puller clamp of FIG. 3 in an open position.
Figure 5:
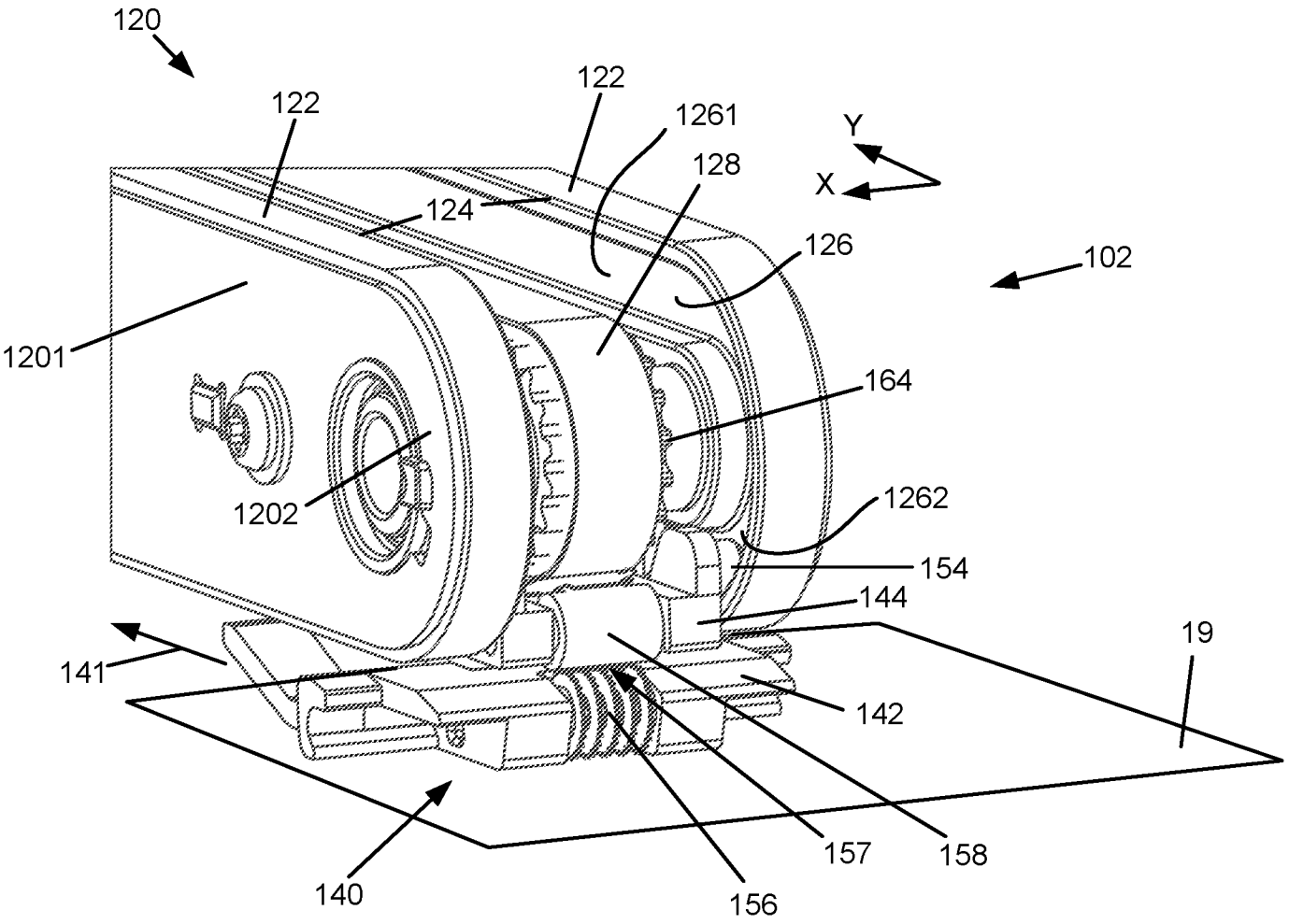
FIG. 5 illustrates an example of a portion of a media registration system with the puller clamp of FIG. 3 in a closed position.

In one implementation, and as illustrated in FIGS. 2, 4, and 5, each puller track 120 includes opposing sideplates 122 with facing or opposing surfaces or sides 124 and channels or grooves 126 formed in facing or opposing surfaces or sides 124. In addition, each puller track 120 includes a belt 128 supported between sideplates 122 for linear movement between opposite ends of puller track 120 relative to sideplates 122. As such, puller clamps 140 are secured or attached to belt 128 for movement with belt 128 between opposite ends of puller track 120. In one implementation, belt 128 is an endless belt supported for rotation between sideplates 122, with multiple puller clamps 140 (e.g., two puller clamps 140) spaced (e.g., equidistant) around a length of belt 128, such that, as belt 128 rotates, puller clamps 140 move (and rotate) between opposite ends of puller track 120, as indicated by arrows 141.

In one implementation, each puller track 120 includes a straight or linear portion 1201, with upper and lower straight or linear channel or groove portions 1261, and curved portions 1202, with respective curved channel or groove portions 1262, at opposite ends thereof. In one example, curved channel or groove portions 1262 include 180 degree portions such that curved channel or groove portions 1262 connect upper and lower straight or linear channel or groove portions 1261. As such, upper and lower straight or linear channel or groove portions 1261 and curved channel or groove portions 1262 form a continuous channel or groove between and to opposite ends of puller track 120. Thus, with puller clamps 140 attached to a respective belt 128, puller clamps 140 follow or move within a path including two straight portions and two curved portions that rotate puller clamps 140 through 180 degrees.

Puller drive system 160 moves puller clamps 140 along puller tracks 120. More specifically, puller drive system 160 moves belt 128 and puller clamps 140, as attached to belt 128, relative to puller track 120. In one example, puller drive system 160 rotates belt 128 to move belt 128 and puller clamps 140, as attached to belt 128, relative to puller track 120. In one implementation, puller drive system 160 supplies rotational motion to belt 128 by a shaft 162 and a gear 164 (FIG. 5) which is mounted on shaft 162 (e.g., between sideplates 122 of puller track 120) and engaged or meshed with belt 128.

X-registration system 180 provides for alignment in the X axis. More specifically, X-registration system 180 shifts or translates puller tracks 120 in the X direction (e.g., perpendicular to the direction of belt transport) to achieve alignment of a sheet of media in the X axis, as described below. In one implementation, X-registration system 180 includes an X-registration drive 184 to provide side-to-side translation of puller tracks 120, as indicated by double arrow 186, in a direction orthogonal to a driven direction of belt 128. In addition, in one example, X-registration system 180 includes X-registration wall (or walls) 182 which provides a surface (or surfaces) that arrest movement of the sheet in the X direction to provide X alignment.

In one implementation, Y-registration wall (or walls) 192 provide a surface (or surfaces) that arrest movement of a sheet of media in the Y direction (e.g., in the direction of belt transport) to provide Y alignment and achieve registration of a sheet of media in the Y axis, as described below.

Figure 3:
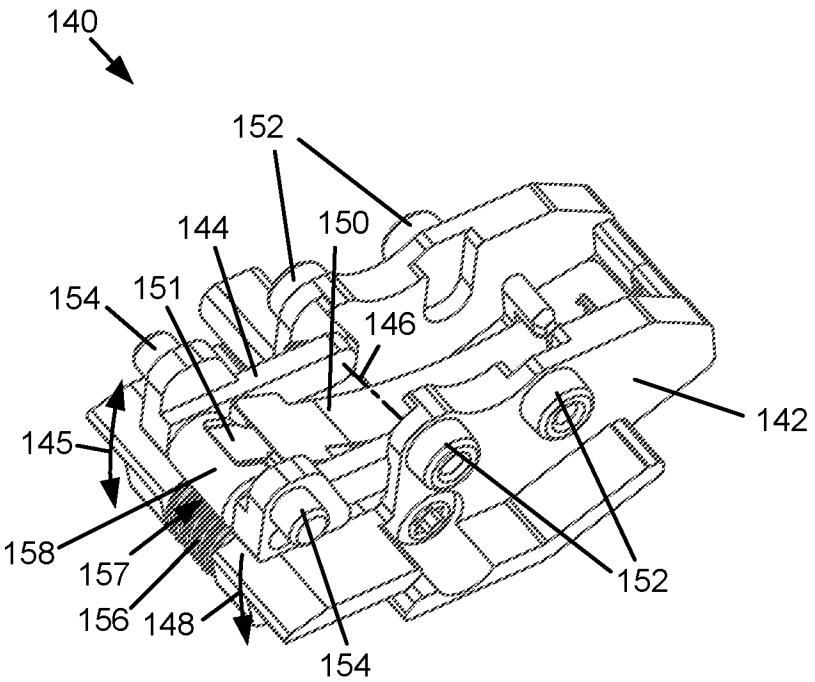
FIG. 3 illustrates an example of a puller clamp for a media registration system.

FIG. 3 illustrates an example of puller clamp 140 for media registration system 100. As described herein, puller clamps 140 open to accept an incoming sheet of media, and close on an accepted sheet of media to transport and register the sheet of media.

In one example, puller clamps 140 include a shuttle 142 and a pivot member 144 pivotally coupled with shuttle 142. In one example, shuttle 142 is coupled with or attached to belt 128 (FIGS. 4, 5) such shuttle 142 moves with belt 128. Since pivot member 144 is pivotally coupled with shuttle 142, pivot member 144 also moves with belt 128. However, as pivot member 144 moves with belt 128, pivot member 144 also pivots relative to shuttle 142, as indicated by double arrow 145. In one example, pivoting of pivot member 144 relative to shuttle 142 creates or establishes an open position and a closed position of puller clamp 140, as described below. In one example, pivot member 144 pivots relative to shuttle 142 about an axis 146.

In one implementation, pivot member 144 is biased to the closed position, for example, in a direction indicated by arrow 148. In one example, pivot member 144 is biased by a flat spring or plate spring 150 extended or positioned between shuttle 142 and pivot member 144 so as to apply a bias force to pivot member 144 in the direction indicated by arrow 148.

In one example, shuttle 142 and pivot member 144 include respective features which interact within channels or grooves 126 of puller track 120 to retain and guide shuttle 142 and pivot member 144 within puller track 120. For example, in one implementation, shuttle 142 and pivot member 144 include respective tabs or pins 152 and 154 which slide within channels or grooves 126 of puller track 120 to retain and guide shuttle 142 and pivot member 144 within puller track 120. In one example, shuttle 142 includes two sets of pins 152 protruding or extending on opposite sides thereof, and pivot member 144 includes one set of pins 154 protruding or extending from opposite sides thereof. As such, pins 152 and pins 154 slide within channels or grooves 126 of puller track 120 to open and close puller clamp 140 as puller clamp 140 moves along or around puller track 120. More specifically, and as described below, pins 152 and pins 154 slide within channels or grooves 126 of puller track 120 and provide pivoting of pivot member 144 relative to shuttle 142 (due to pivot member 144 being pivotally coupled with shuttle 142) to open and close puller clamp 140 as puller clamp 140 moves along or around puller track 120.

In one implementation, shuttle 142 and pivot member 144 include opposing rollers 156 and 158, respectively. As such, rollers 156 and 158 create a nip or pinch zone or pinch 157 to receive and hold a sheet of media. In one implementation, roller 158 is a solid wheel roller, and roller 156 is a star wheel roller comprised of multiple, stacked star wheels.

In one example, pinch 157 is opened and closed as puller clamp 140 moves along or around puller track 120. More specifically, and as described below, as shuttle 142 and pivot member 144 move through curved portion 1202 of puller track 120, pivot member 144 pivots relative to shuttle 142 to open and close pinch 157. For example, as shuttle 142 (including, more specifically, pins 152 of shuttle 142) reaches the lower linear portions of grooves 126, pivot member 144 (including, more specifically, pins 154 of pivot member 144) is still in the curved portions of grooves 126. This difference in position of shuttle 142 (including, more specifically, pins 152 of shuttle 142) and pivot member 144 (including, more specifically, pins 154 of pivot member 144) creates the opening/closing behavior of puller clamp 140.

FIG. 4 illustrates an example of puller clamp 140 in an open position, and FIG. 5 illustrates an example of puller clamp 140 in a closed position. More specifically, as illustrated in the example of FIG. 4, puller clamp 140 (as representative of puller clamps 140 on both puller tracks 120) is positioned at receiving end 102 of media registration system 100 such that pivot member 144 is pivoted relative to shuttle 142 (namely, away from shuttle 142). For example, with prescribed movement of belt 128, shuttle 142 and pivot member 144 are positioned along puller track 120 such that pins 152 (FIG. 3) of shuttle 142 are positioned in the lower linear portions of grooves 126 and pins 154 of pivot member 144 are positioned in the curved portions of grooves 126. As such, rollers 156 and 158 are spaced from each other such that pinch 157 is in (or held in) an open position. With pinch 157 in the open position, puller clamp 140 may receive a sheet of media, for example, a sheet of printed media output, as schematically represented by outlined media 19. Thus, FIG. 4 illustrates an example of a media accept position of puller clamp 140.

As illustrated in the example of FIG. 5, as puller clamp 140 is moved from receiving end 102 toward registration end 104 (FIG. 2) of media registration system 100, pivot member 144 is pivoted relative to shuttle 142 (namely, toward shuttle 142). For example, with prescribed movement of belt 128, shuttle 142 and pivot member 144 are moved along puller track 120 such that pins 154 of pivot member 144 are moved from the curved portions of grooves 126 to the lower linear portions of grooves 126. Thus, pins 152 (FIG. 3) of shuttle 142 and pins 154 of pivot member 144 are all positioned in the lower linear portions of grooves 126. As such, rollers 156 and 158 are brought together such that pinch 157 is in (or is held in) a closed position. With pinch 157 in the closed position, a sheet of accepted media, as schematically represented by outlined media 19, may be clamped or held within puller clamp 140 such that puller clamp 140 may transport and register the sheet of media, as described below. Thus, FIG. 5 illustrates an example of a media transport and/or media registration position of puller clamp 140.

In one example, after the sheet of media is clamped or accepted by puller clamps 140, the sheet of media is transported along puller tracks 120 to X and/or Y registration positions for alignment in the X direction and/or the Y direction, as described below.

Figure 6:
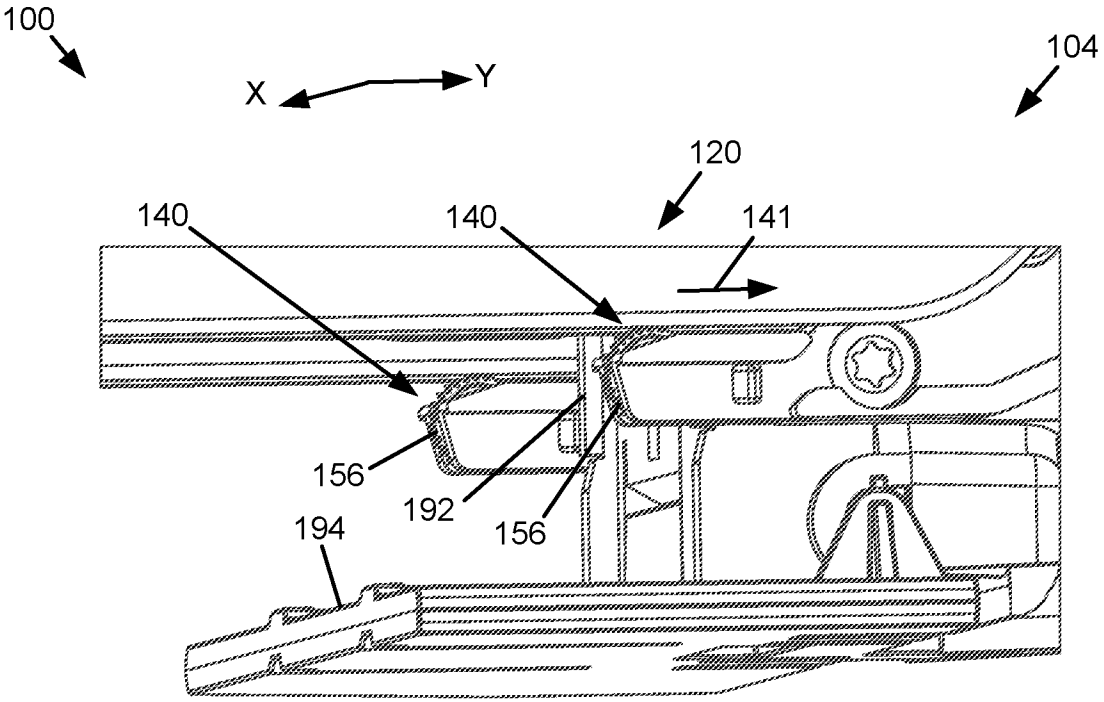
FIG. 6 illustrates an example of a portion of a media registration system.
Figure 7:
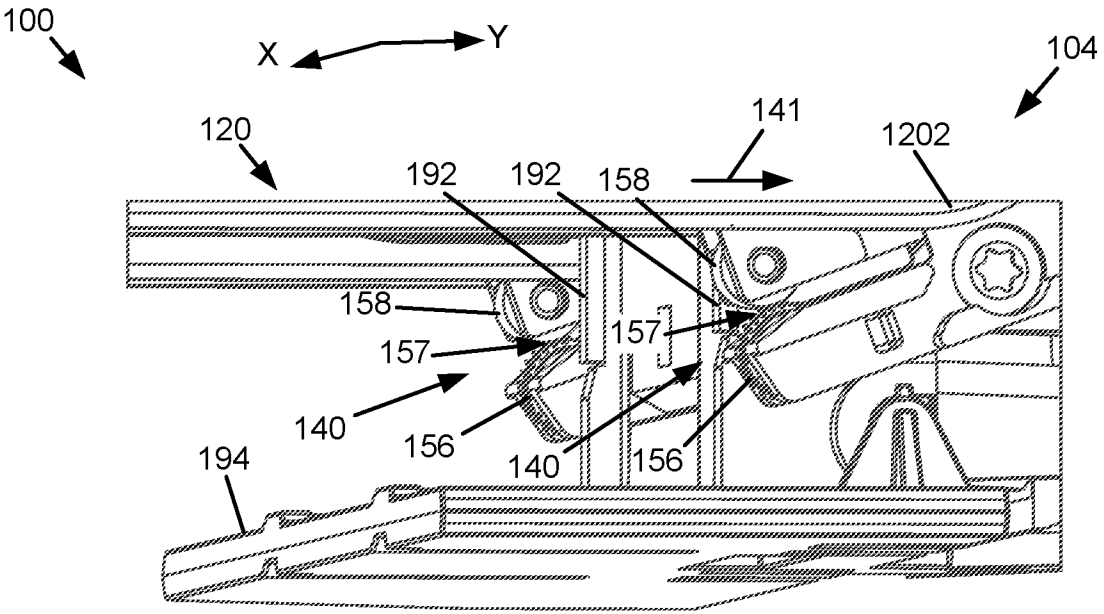
FIG. 7 illustrates an example of a portion of a media registration system.

FIGS. 6 and 7 illustrate examples of puller clamps 140 at registration end 104 of media registration system 100. More specifically, FIG. 6 illustrates an example of puller clamps 140 and Y-registration wall (or walls) 192 before Y registration and release of the sheet of media, and FIG. 7 illustrates an example of puller clamps 140 and Y-registration wall (or walls) 192 after Y registration and release of the sheet of media. In one example, Y registration occurs after X registration, for example, by X-registration system 180 (FIG. 2), as described below. In the example illustrated in FIG. 7, puller clamps 140 are at and start to rotate about curved portions 1202 of puller tracks 120 as puller clamps 140 are moved, for example, to a "park" position (as illustrated, for example, in FIG. 2) at end 104.

In one example, as puller clamps 140 approach Y-registration wall (or walls) 192, the sheet of media (as held by puller clamps 140) is positioned over a media support surface 194 (only a portion of which is illustrated as an example). As such, puller clamps 140 continue to transport the sheet in the Y direction until an edge (proud edge) of the sheet contacts Y-registration wall (or walls) 192. With puller clamps 140 at Y-registration wall (or walls) 192, an extent to which the sheet of media contacts Y-registration wall 192, including one of, all, or less than all Y-registration walls, depends on an initial skew of the sheet.

In one implementation, with contact of the sheet with Y-registration wall (or walls) 192, the sheet creates a drag force on puller clamps 140 such that rollers 156 and 158 of puller clamps 140 start to rotate. As such, rotation of rollers 156 and 158 allows the sheet to be removed or released from pinch 157 and, therefore, removed or released from puller clamps 140 after or to complete Y registration. In one example, the amount of force it takes for a sheet to pull out of rollers 156 and 158 and be released from puller clamps 140 (during Y registration versus dragging the sheet in place) is set by a flat spring or plate spring 151 (FIG. 3) positioned beneath spring 150 and in contact with roller 158.

In one implementation, the drag force on rollers 156 and 158 is established or controlled such that the pinch force of puller clamps 140 (namely, the pinch force of rollers 156 and 158) is sufficient to transport the sheet of media (including different media sizes and orientations) while not over-constraining the sheet of media, thereby allowing the sheet to rotate rollers 156 and 158 and be released from rollers 156 and 158 and, therefore, be released from puller clamps 140, as the sheet contacts Y-registration wall (or walls) 192. In one implementation, the drag force on rollers 156 and 158 is established or controlled such that the pinch force of puller clamps 140 does not buckle the sheet of media as the sheet contacts the Y-registration wall (or walls) 192, and does not impart energy (i.e., bounce back) into the sheet of media as the sheet exits the nip or pinch of rollers 156 and 158.

In one example, after the sheet has been registered, puller clamps 140 continue around end 104 of puller tracks 120. In one example, puller clamps 140 are moved to intake or receiving end 102 (FIG. 2) of media registration system 100 to assume a "home" position in preparation for accepting a next sheet of media.

FIGS. 8A, 8B, 8C, 8D are schematic illustrations of an example of media registration with a media registration system, such as media registration system 100, including, more specifically, registration of a sheet of media, such as media 19, in X and Y directions.

Figure 8A:
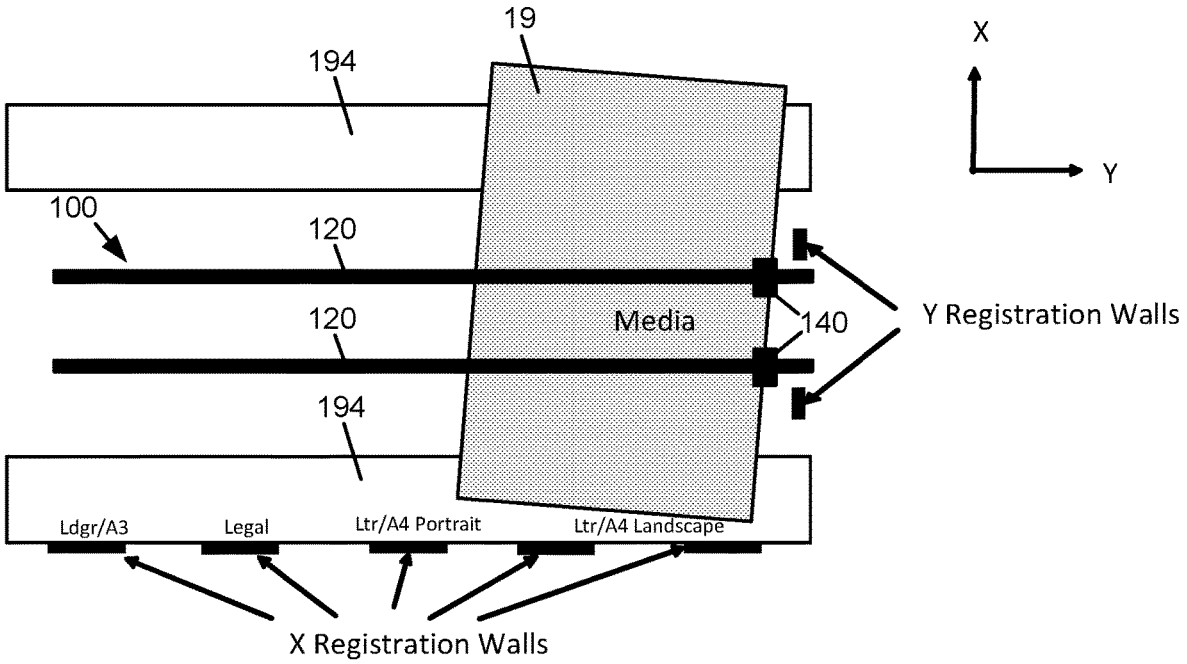
FIGS. 8A, 8B, 8C, 8D are schematic illustrations of an example of media registration.

In one example, as illustrated in FIG. 8A, to initiate a sequence of media registration system 100 in registering a sheet of media 19 in X and Y directions, media 19, as positioned above media support surfaces 194, is transported to an X-alignment position by, for example, puller clamps 140 (FIGS. 2, 4, 5) and puller tracks 120 (FIGS. 2, 4, 5). In one example, the X-alignment position is near both the X and Y registration positions (i.e., X and Y registration wall or walls).

Figure 8B:
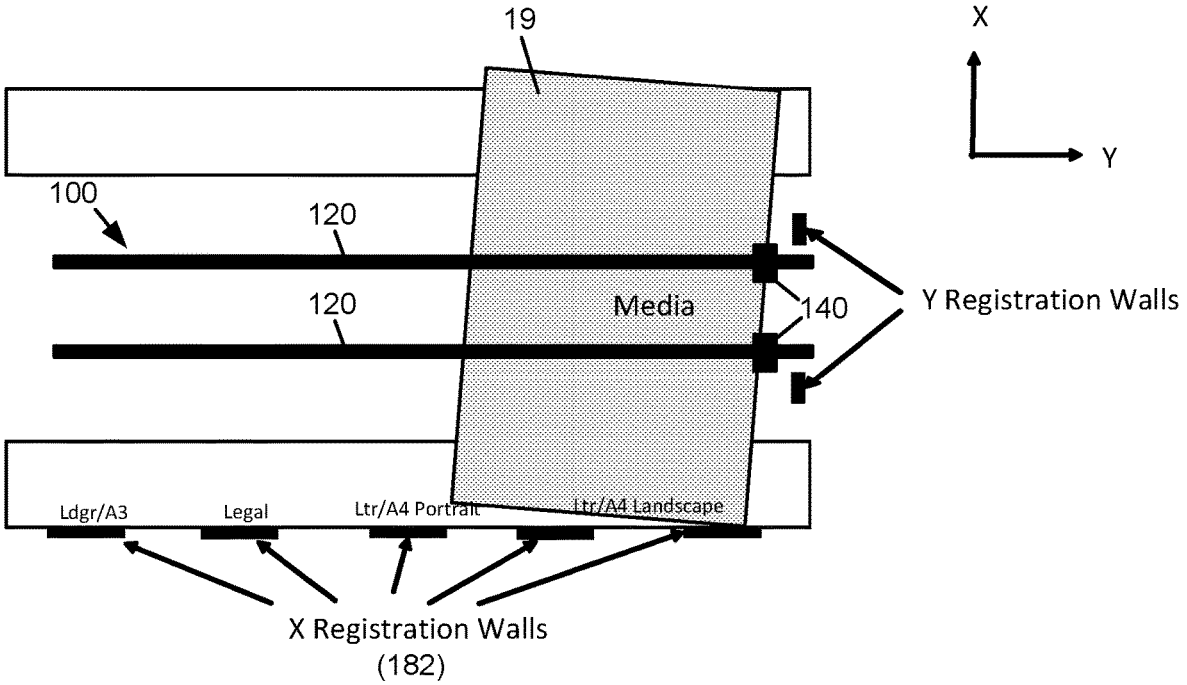

In one example, as illustrated in FIG. 8B, to continue the sequence of media registration system 100 in registering media 19 in X and Y directions, media 19 is moved to the X registration position including, more specifically, X-registration wall (or walls) 182. In one implementation, X-registration wall (or walls) 182 includes multiple registration walls to accommodate differing sizes and/or orientations of media.

In one implementation, X registration is accomplished by X-registration drive 184 (FIG. 2), as connected to puller tracks 120 (FIGS. 2, 4, 5), which translates puller tracks 120, and puller clamps 140 (FIGS. 2, 4, 5) as supported by puller tracks 120, in the X direction, as indicated by double arrow 186 (FIG. 2). Since media 19 is held by puller clamps 140, media 19 is also moved with the translation of puller tracks 120. In one example, X-registration drive 184 receives input of the X location of the edge of media 19 (e.g., from a sensor), and moves media 19 perpendicular to the transport direction of puller tracks 120 to contact positioned or established X-registration wall (or walls) 182.

Figure 8C:
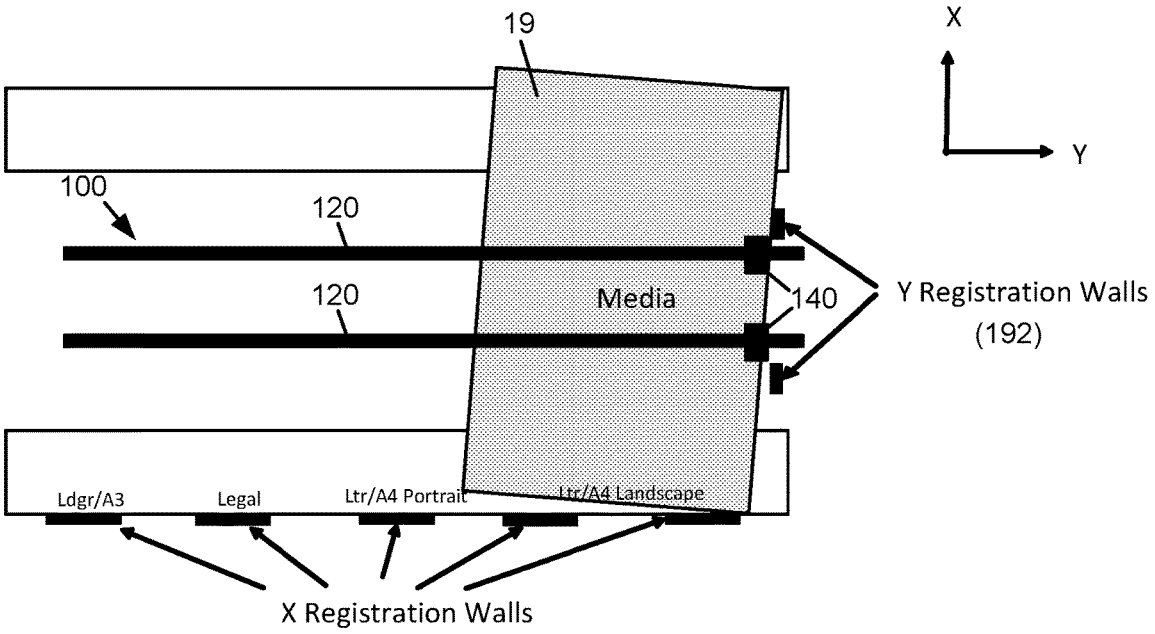

In one example, as illustrated in FIG. 8C, to continue the sequence of media registration system 100 in registering media 19 in X and Y directions, media 19 is transported in the Y direction until an edge of media 19 contacts Y-registration wall (or walls) 192. More specifically, an extent to which media 19 contacts Y-registration wall 192, including one of, all, or less than all Y-registration walls, depends on an initial skew of media 19.

Figure 8D:
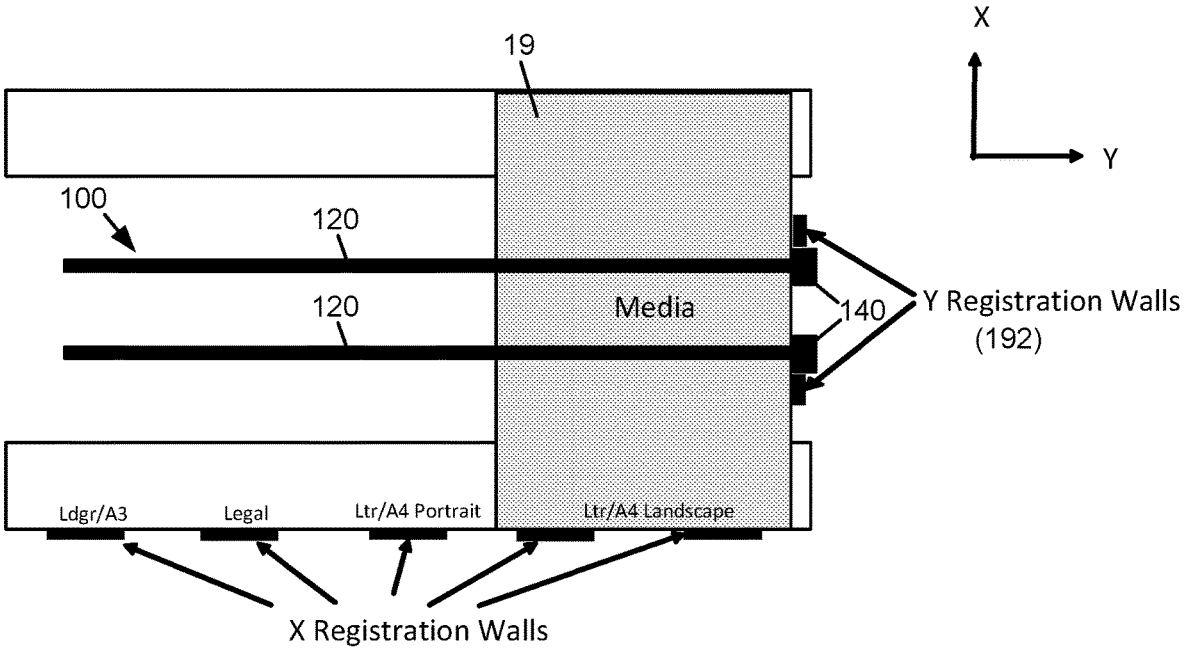

In one example, as illustrated in FIG. 8D, to complete the sequence of media registration system 100 in registering media 19 in X and Y directions, media 19 is pivoted in the Z direction (theta) based on an initial contact point and Y direction movement of puller clamps 140 (FIGS. 2, 4, 5). More specifically, arresting of media 19 by an initial Y-registration wall (or walls) 192 causes media 19 to rotate about the initial contact point until media contacts another Y-registration wall (or walls) 192. As such, rotation of media 19 in the Z direction (theta) helps to remove any existing page skew. In one implementation, the rotation of media 19 is provided by pinch 157 (FIGS. 3, 7) of puller clamps 140. More specifically, when media 19 contacts Y-registration wall (or walls) 192 and stops moving, media 19 creates a drag force on puller clamps 140 which causes rollers 156 and 158 (FIGS. 3, 5, 7) of puller clamps 140 to rotate such that rotation of rollers 156 and 158 releases media 19 from roller clamps 140 whereby X and Y registration of media 19 is completed.

Figure 9:
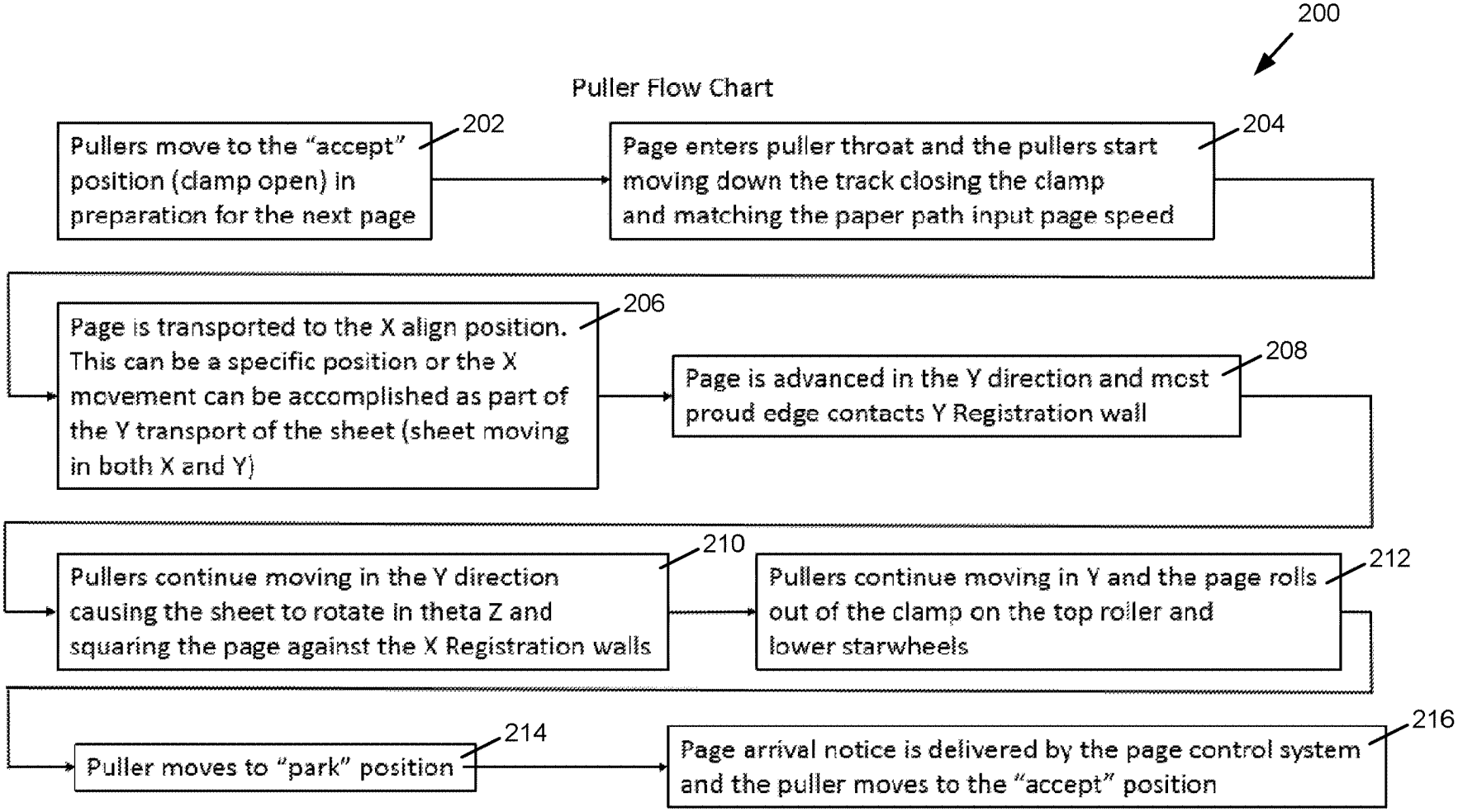
FIG. 9 is a flow chart illustrating an example of a sequence of registering media in a printing system.

FIG. 9 is a flow chart illustrating an example of a sequence 200 of registering media in a printing system, such as inkjet printing system 10 (FIG. 1), with a media registration system, such as media registration system 100. As such, and with reference to FIGS. 2, 3, 4, 5, 6, 7, 8A, 8B, 8C, 8D, sequence 200 includes media registration with puller tracks 120 and puller clamps 140.

In one example, at 202, puller clamps 140 move to the "accept" position (with puller clamps 140 being open) in preparation for the next sheet of media.

In one example, at 204, the sheet of media enters open puller clamps 140, for example, between shuttle 142 and pivot member 144 (i.e., puller throat), and puller clamps 140 start moving along puller tracks 120 so as to close puller clamps 140. In one implementation, a speed of puller clamps 140 along puller tracks 120 is established to match an input speed of the sheet.

In one example, at 206, the sheet of media is transported to the X alignment position. The X alignment can be accomplished at a specific position, or movement for the X alignment can be accomplished as part of the transport of the sheet in the Y direction (for example, movement of the sheet in both the X and Y directions as the sheet is transported in the Y direction).

In one example, at 208, the sheet of media is advanced in the Y direction, and the most proud edge of the sheet contacts Y-registration wall (or walls) 192.

In one example, at 210, puller clamps 140 continue to move in the Y direction, thereby causing the sheet of media to rotate in the Z direction (theta) so as to square the sheet against the X-registration wall (or walls) 182.

In one example, at 212, puller clamps 140 continue to move in the Y direction such that the sheet of media is released from puller clamps 140 (e.g., rolls out of puller clamps 140 between the top roller and the lower star wheels).

In one example, at 214, puller clamps 140 move to a "park" position (for example, along the top side of the puller tracks 120 at registration end 104).

In one example, at 216, an arrival notice of a next sheet of media is received (e.g., from a media control system), such that puller clamps 140 are moved to the "accept" position at intake or receiving end 102 in preparation for the next sheet of media.

Figure 10A:
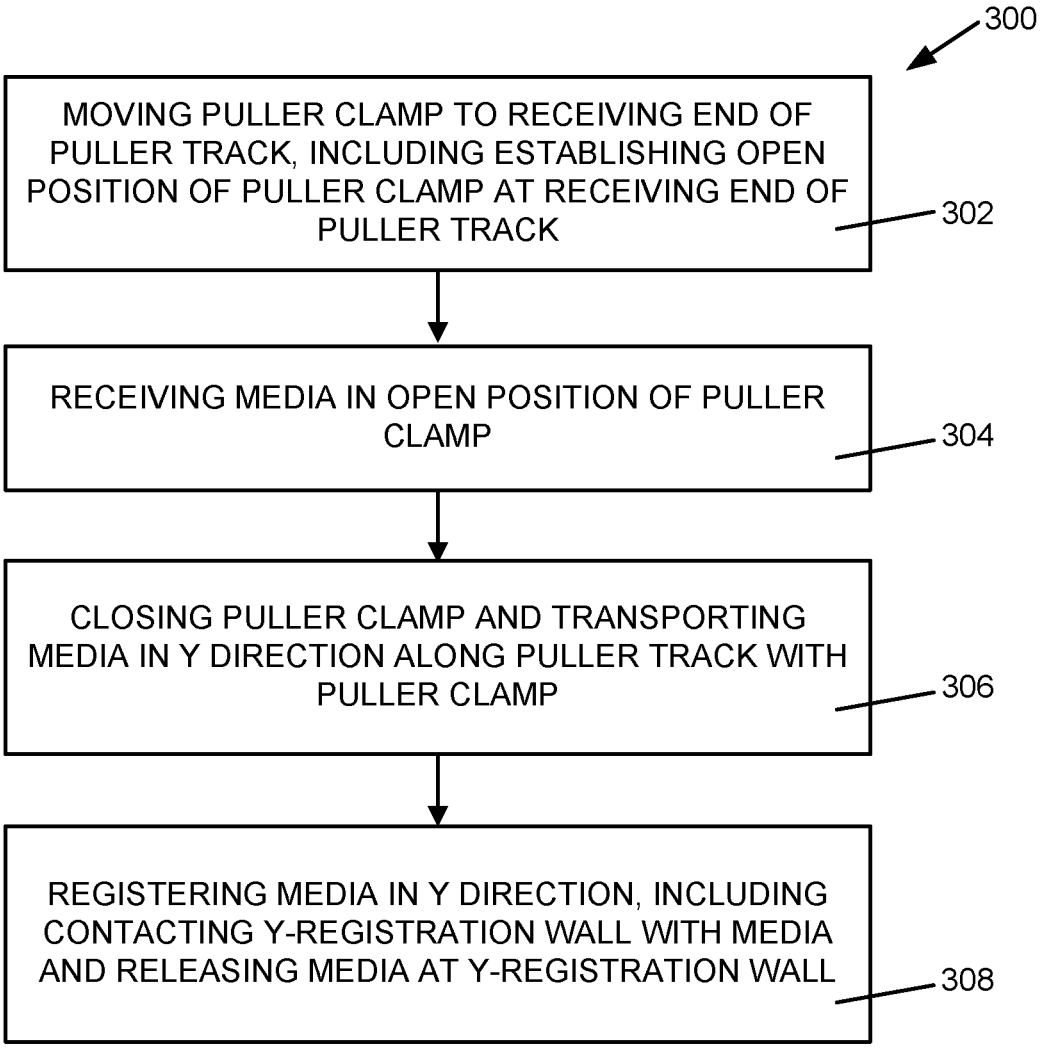
FIGS. 10A, 10B are flow diagrams illustrating an example of a method of registering media in a printing system.
Figure 10B:
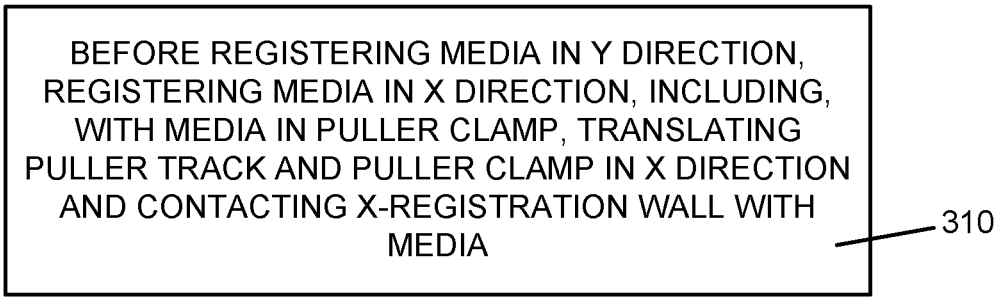

FIGS. 10A, 10B are flow diagrams illustrating an example of a method 300 of registering media in a printing system, such as inkjet printing system 10 (FIG. 1), with a media registration system, such as media registration system 100.

In one example, as illustrated in FIG. 10A, at 302, method 300 includes moving a puller clamp, such as puller clamp 140, as illustrated, for example, in FIGS. 2, 4, to a receiving end of a puller track, such as end 102 of puller track 120, as illustrated, for example, in FIGS. 2, 4, with moving the puller track including establishing an open position of the puller clamp at the receiving end of the puller track, as illustrated, for example, in FIG. 4.

As such, at 304, method 300 includes receiving media in the open position of the puller clamp, as schematically illustrated, for example, in FIG. 4.

As such, at 306, method 300 includes closing the puller clamp and transporting the media in a Y direction along the puller track with the puller clamp, as schematically illustrated, for example, in FIGS. 5, 8A.

As such, at 308, method 300 includes registering the media in the Y direction, including contacting a Y-registration wall, such as Y-registration wall (or walls) 192, as illustrated, for example, in FIGS. 2, 6, 7, 8C, with the media and releasing the media at the Y-registration wall, as schematically illustrated, for example, in FIG. 8D.

In one example, as illustrated in FIG. 10B, at 310, before registering the media in the Y direction, for example, at 308, method 300 includes registering the media in an X direction, which includes, with the media in the puller clamp, translating the puller track and the puller clamp in the X direction, as represented, for example, by double arrow 186 in FIG. 2, and contacting an X-registration wall, such as X-registration wall (or walls) 182, as illustrated, for example, in FIGS. 2, 8B, with the media.

With a media registration system as disclosed herein, since the puller clamps and the puller tracks together provide for both the transport of the sheet and the registration of the sheet in both axes, the system is less sensitive to curl, sheet stiffness and sheet to sheet friction. More specifically, with a media registration system as disclosed herein, the page alignment and skew control provided may be maintained since the sheet is retained and is not released until the X and Y registration process is complete, such that re-registration during a registration process may be avoided.

In addition, with a media registration system as disclosed herein, utilizing rollers in the puller clamps helps to minimize the potential for damage to the sheet, including, more specifically, a leading edge of the sheet. In addition, with a media registration system as disclosed herein, reliance on the stiffness of the sheet after printing to achieve acceptable page alignment is reduced or eliminated, and the potential impact of surface friction changes caused by the addition of moisture to the page is lessened or avoided. In addition, with a media registration system as disclosed herein, the system can handle a high level of sheet curl (e.g., 30+mm), and can handle a wide range of media types, sizes, and orientations. Furthermore, with a media registration system as disclosed herein, the X registration system allows the X movement of each sheet to be specific for the offset of each sheet, and the speed of the registration process may be independent of the output speed of media from the print engine.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein.

The invention claimed is:

1. A media registration system, comprising:

a first puller clamp to receive and hold a sheet of media;

a second puller clamp to receive and hold the sheet of media;

a first puller track to support the first puller clamp, the first puller track to open and close the first puller clamp with movement of the first puller clamp along the first puller track in a direction of transportation;

a second puller track to support the second puller clamp, the second puller track to open and close the second puller clamp with movement of the second puller clamp along the second puller track in the direction of transportation; and a registration system including a registration wall, the registration system to translate the first and second puller tracks with respect to one another in a direction perpendicular to the direction of transportation when the first puller clamp and the second puller clamp are in closed positions to align the sheet of media in the direction perpendicular to the direction of transportation against the registration wall.

2. The media registration system of claim 1, wherein the first puller track includes opposing grooves, wherein the first puller clamp includes pins fit within the opposing grooves to guide the first puller clamp along the first puller track and open and close the first puller clamp.

3. The media registration system of claim 2, wherein the first puller clamp includes a shuttle and a pivot member coupled with the shuttle, wherein sliding of the pins within the opposing grooves pivots the pivot member to open and close the first puller clamp.

4. The media registration system of claim 1, wherein the first puller track includes a linear portion and a curved portion at an end of the linear portion, wherein the first puller clamp is to open at the curved portion to receive media and close at the linear portion to transport the media.

5. A media registration system, comprising:

a first puller track;

a second puller track;

a first and second puller clamps to transport a sheet of media in a direction of transportation, the first puller clamp guided by the first puller track, the second puller clamp guided by the second puller track; wherein the first and second puller clamps each include a shuttle and pivot member pivotally coupled with the shuttle to form a pinch therebetween, the pinch to open and close with movement of a respective puller clamp along a respective puller track;

a registration system including a registration wall, the registration system to translate the first and second puller tracks with respect to one another in a direction perpendicular to the direction of transportation when the respective pinch of the first and second puller clamps are closed to align the sheet of media in the direction perpendicular to the direction of transportation against the registration wall.

6. The media registration system of claim 5, wherein the pinch formed by the shuttle and pivot member of the first puller clamp includes a first roller supported by the shuttle and a second roller supported by the pivot member.

7. The media registration system of claim 6, wherein the first roller comprises a star wheel.

8. The media registration system of claim 5, wherein the pivot member of the first puller clamp is biased toward the shuttle of the first puller clamp to close the pinch formed at the first puller clamp.

9. The media registration system of claim 8, wherein the pivot member is pivoted away from the shuttle by the first puller track to open the pinch.

10. The media registration system of claim 5, further comprising:

a first belt rotatably supported by the first puller track, wherein the shuttle of the first puller clamp is secured to the first belt for rotation therewith.

11. A media registration method, comprising:

moving a first puller clamp to a receiving end of a first puller track, including establishing an open position of the first puller clamp at the receiving end of the first puller track;

moving a second puller clamp to a receiving end of a second puller track, including establishing an open position of the second puller clamp at the receiving end of the second puller track;

receiving media in the open positions of the first and second puller clamps;

closing the first and second puller clamps and transporting the media in a Y direction along the first and second puller tracks with the first and second puller clamps;

while the first and second puller clamps are closed, registering the media in an X direction perpendicular to the Y direction, including translating the first and second puller tracks with respect to one another in the X direction to align the media in the X direction against an X-registration wall; and registering the media in the Y direction, including contacting a Y-registration wall with the media and releasing the media at the Y-registration wall.

12. The media registration method of claim 11, wherein registering the media in the X direction further comprises contacting an X-registration wall with the media.

13. The media registration method of claim 11, wherein establishing the open position of the first puller clamp includes pivoting a pivot member of the first puller clamp relative to a shuttle of the first puller clamp with the moving of the first puller clamp to the receiving end of the first puller track.

14. The media registration method of claim 13, wherein moving the first puller clamp includes guiding both pins of the pivot member of the first puller clamp and pins of the shuttle of the first puller clamp in opposing grooves of the first puller track.

15. The media registration method of claim 11, wherein receiving media in the first puller clamp includes receiving the media between a pinch of the first puller clamp.

* * * * *